United States Patent [19]

Mear et al.

[11] 4,202,143

[45] May 13, 1980

[54] COMBINED FORMWORK AND CAVITY TRAY

[76] Inventors: Brian Mear; Gary Smith, both of 26A Bull Ring, Ludlow, Shropshire, England

[21] Appl. No.: 914,514

[22] Filed: Jun. 12, 1978

[51] Int. Cl.[2] ..... E04D 13/00; E06B 1/04; E06B 1/24

[52] U.S. Cl. ..... 52/97; 52/204

[58] Field of Search ..... 52/85, 204, 89, 412, 52/454, 97

[56] References Cited

U.S. PATENT DOCUMENTS

| | | | |
|---|---|---|---|
| 2,669,114 | 2/1954 | Mills | 52/454 |
| 3,605,372 | 9/1971 | Wunderlich et al. | 52/204 |

FOREIGN PATENT DOCUMENTS

| | | | |
|---|---|---|---|
| 124271 | 5/1947 | Australia | 52/204 |
| 1965465 | 12/1968 | Fed. Rep. of Germany | 52/204 |
| 694214 | 3/1951 | United Kingdom | 52/204 |

*Primary Examiner*—James L. Ridgill, Jr.
*Attorney, Agent, or Firm*—Albert L. Jeffers

[57] ABSTRACT

A combined formwork and cavity tray element for use in the construction industry having first and second web portions joined together by a third web portion forming an included angle of more than 90° with each of the first and second web portions. The first web portion is substantially straight throughout its longitudinal direction and the second web portion is curved in the vertical direction towards the plane containing the uppermost elongate flat surface of the first web portion. If desired, the element may include a box-section wherein the second web portion comprises the top wall thereof.

12 Claims, 4 Drawing Figures

11
13
10
17
12
14
15
16
18

COMBINED FORMWORK AND CAVITY TRAY

This invention relates to a combined formwork and cavity tray.

A lot of housing and other buildings built in earlier times have windows or other wall openings whose upper ends are defined by arches and these arches were made from stone or by using special bricks (sometimes called rubbed bricks) which are so shaped or formed as to fit against one another properly when stood on end to constitute an arch. These arches, together with the height and width dimensions of the openings in relation to the height and width dimensions of the building elevation often account for the attractive appearance of the building as a whole.

Nowadays, many of these older structures are being renovated and local authorities in the United Kingdom have become very keen to try to ensure that the builder will not ruin the overall appearance of the building by unintelligent or ignorant renovation. In a great many cases, the arches at the heads of windows are taken out because the original window frames have become unserviceable due to age and poor maintenance and because the new replacement windows will differ in height and in width from the ones removed; relacing the head arches and making the necessary spandrel to fill the space between the top of the window frame and the underside of said arch is expensive in terms of labour and materials.

Some of the buildings being renovated were provided with cavity walls or alternatively could easily be provided with cavity walls by the building of an inner wall of building blocks. It is also desired for some new housing developments to provide windows having arched heads. When the wall of the building has a cavity wall, the inner skin and the outer skin will need to be bridged in some way in order to deflect any rainwater and/or condensation from within the cavity to the outside. Such rainwater and/or condensation must not be allowed to come into contact with the upper edge of the window, door, etc. and this is usually achieved either by the use of a lintel made of dense concrete (possible reinforced by mild steel bars) or by the use of a structural element made of galvanised steel. In both the concrete lintel and the steel lintels which are at present on the market, at least in the United Kingdom, there is a web which extends across the wall cavity at such an angle that the rainwater and/or condensation is deflected outwardly and forwardly onto a substantially horizontal part of the lintel which extends under, and acts as part of the support for, the lowermost course of brickwork, blockwork or stonework of the outer skin of the cavity wall. Such lintels are said to provide a so-called cavity tray.

The principal object of the present invention is to provide an element which constitutes a combined formwork and cavity tray which will be placed across the head of an opening in a wall and which will support the brickwork, blockwork or stonework of a new arch. A subsidiary object of the invention is to provide an element which constitutes a combined formwork and cavity tray and which provides a spandrel, said element being for use over openings in which there is to be a window-frame or door-frame immediately under the arched head. Although said principal and subsidiary objects are of prime importance in connection with walls of cavity construction, the usefulness of said element is not restricted to cavity walls.

Accordingly, the present invention consists in an element which constitutes a combined formwork and cavity tray for use in bridging an opening in a wall, said element comprising a first web portion and a second web portion which are connected to one another along corresponding inner edges by a third web portion which, in any transverse section through the element, makes an included angle of more than 90° with each of said first and second web portions, said second web portion being curved in the vertical direction towards the plane containing the uppermost elongate flat surface of said first web portion.

Said first web portion may constitute a wall of a box-section member. An appropriate other wall of said box-section member may be provided with keying means to which mortar, cement, or plaster can be applied. Said keying means could comprise a metal lathing or mesh.

Moreover, in a generally preferred embodiment of said element, said second web portion may comprise a top wall of a second box-section member whose transverse cross-sectional area increases from a minimum at each of its ends to a maximum intermediate said ends by virtue of the curvature of said second web portion, the first web portion and the bottom wall of said second box-section member lying on parallel planes. The walls of said second box-section member may enclose a void; said void may be filled with a rigid material having a high thermal resistance. It is desirable for a capillary groove to be formed in said bottom wall. In one form of said preferred embodiment, said top wall is extended in such a manner as to project beyond that side wall of said second box-section member which is remote from said inner edge, thereby providing a head drip. In another form of said preferred embodiment, said top wall is so formed as to provide an indentation or indentations which, in use of the element, will serve as a bed or key for mortar or for a mastic compound used with the brickwork, blockwork or stonework extending upwardly from said top wall.

The preferred materials for the arch form and cavity tray described above are glass reinforced plastics, but other suitable materials are considered to be rigid PVC and the more traditional materials such for example as steel which has been treated with other metals to make it non-rusting.

The present invention will now be more particularly described with reference to the accompanying drawings, in which.

Figure 1:
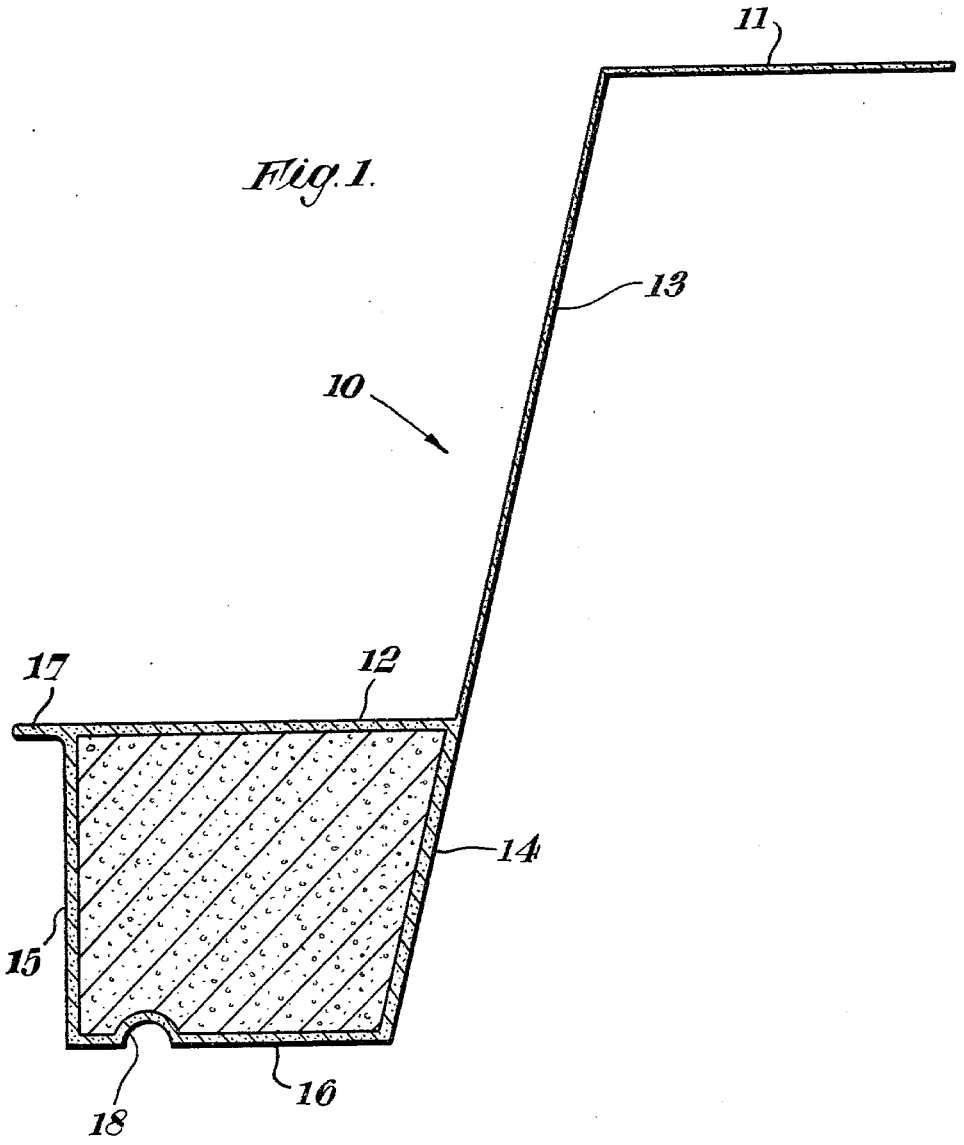
FIG. 1 illustrates a section through the preferred embodiment of an element according to the present invention, said section having been taken in the plane of symmetry of said element.

Referring to the drawings, there is illustrated a one-piece element 10 which comprises a first web portion 11 and a second web portion 12 which are connected to one another along corresponding inner edges by a third web portion 13 which makes an included angle of more than 90° with each of said web portions 11, 12. Whereas the web portion 11 is a flat elongate strip, the web portion 12 is curved (see FIG. 2). A part (in fact, the major proportion) of said web portion 12 comprises the top wall of a box-section member whose three other walls are indicated by the reference numerals 14, 15, 16. As illustrated, the wall 14 can be regarded as an extension of the web portion 13 whereas the wall 15 is perpendicular to the web portion 12. The wall 16 is flat and elongate and forms the bottom wall of the box-section member.

A horizontally directed projection 17, integral with the web portion 12, acts as a head drip. The wall 16 has a capillary groove 18 formed therein. The purposes served by a head drip and a capillary groove are well-known in the construction industry and need not be explained.

It will be seen that the four walls 12, 14, 15 and 16 enclose a void. This void could be left empty but it is preferred to fill it with a material, preferably rigid, which has a high thermal resistance. Such a filling will tend to prevent the occurrence of a so-called cold bridge in the building structure.

The web portions 11 and 13 need not be very thick (for example a thickness of 1 mm is thought to be adequate) whereas the walls making up the box-section member should be thicker because of the weight of building materials which said member will bear. It is recommended that the thickness of the walls 14, 15 and 16 should be 4 mm but such thicknesses are not to be taken as being critical figures.

Figure 2:
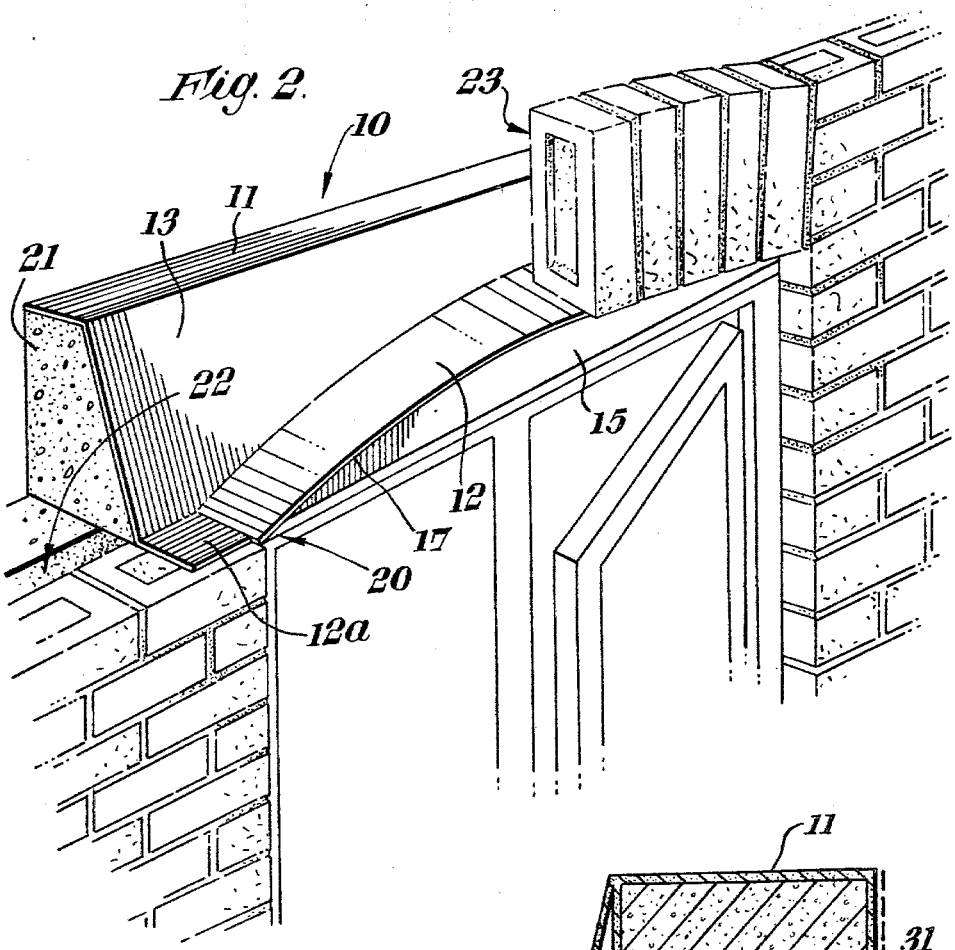
FIG. 2 illustrates a perspective view of the complete element being used to bridge an opening in a wall and to assist in the formation of an arch.

It will be appreciated that the transverse cross-sectional area of the box-section member varies from a minimum at its ends of which one is approximately indicated by the reference numeral 20 in FIG. 2, to a maximum intermediate said ends. As an arch is symmetrical about a vertical plane containing the centre point of the arch, in practice the maximum cross-sectional area will be at the centre of the arch but the element according to the present invention could by used to provide any asymmetrical arch.

FIG. 2 illustrates a cavity wall having an opening in which a window has been positioned. A concrete lintel 21 has its opposite end portions placed on the inner wall parts so as to bridge the opening and also so as to extend across a wall cavity 22. The element 10 has been placed so that the web portions 11, 13 are in contact with corresponding surfaces of the lintel 21 and so that end portions **12*a* of the web portion 12 are supported by the brickwork abutments of the brick arch which is to be built. It will be seen that the box-section member spans the opening between the abutments and that a course 23 of bricks is being laid soldier-fashion on the curved upper surface of the web portion 12. The box-section member provides ample strength to support the course 23 and the spandrel wall to permit the mortar to harden; thereafter the brick arch provides the structural strength. Thus, the element 10 illustrated in the drawings is considered to be a formwork which is left in situ to form a part of the structure without being required to meet the technical requirements of a structural element such for example as a load-bearing lintel. Moreover, the outer surface of the wall 15 of the element 10** provides a weather-proof filler for the spandrel without any additional work being required on the part of the builder.

An alternative element according to the invention does not have the walls 14, 15, 16 which, in conjunction with the upwardly curved second web portion 12, constitute the box-section member. Said web portion 12 would then simply be a curved part of the element and could be used over openings where there is to be no window-frame or door-frame immediately under the arched head (for example where a front door is recessed back from an arched wall opening to provide a covered porch). Such alternative element is also formwork which is not required to meet the technical requirements of a structural element.

Figure 4:
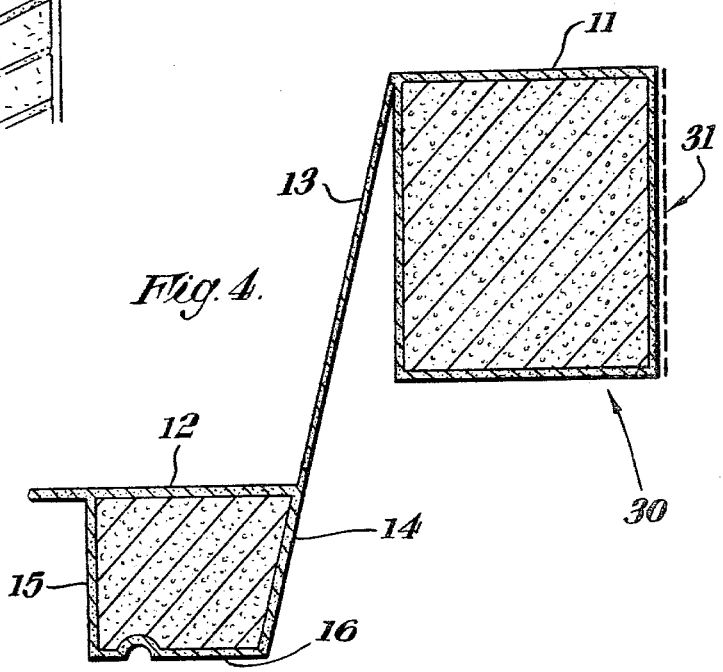
FIG. 4 illustrates a section through a second alternative embodiment of an element according to the present invention.
Figure 3:
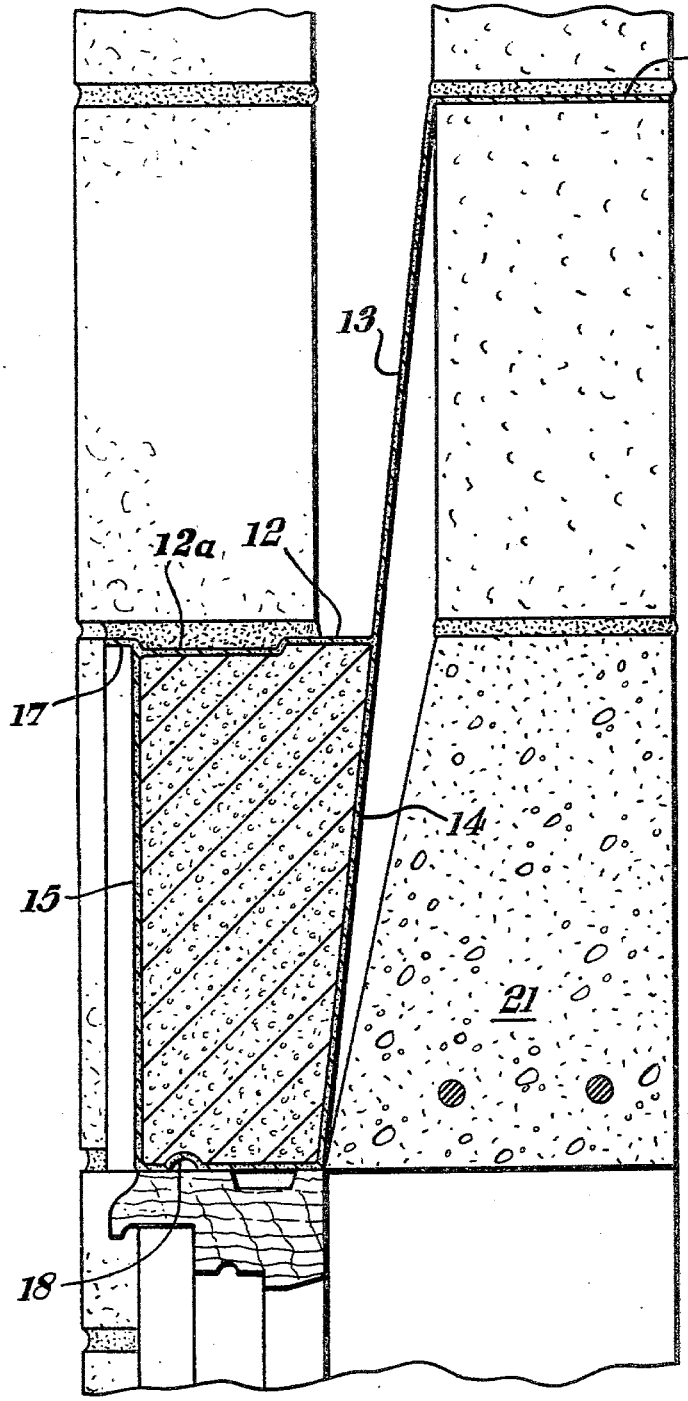
FIG. 3 illustrates a transverse section through an alternative embodiment of an element according to the present invention, said element having been built into a cavity wall and also being provided with a groove-like indentation acting as a mortar bed.

However, if it is considered to be desirable to provide a structural element, the web portion 11 could become the top wall of a box-section lintel which is generally indicated in FIG. 4 by the reference numeral 30 and which could be such as to have its opposite walls parallel to one another, the web portion 13 being attached to said lintel along the upper front corner of the box. Said box-section lintel 30 could comprise either a completely empty void or a void filled with a material (preferably rigid) having a high thermal resistance to avoid the occurrence of a cold bridge. The lintel 30 could be provided at the position indicated with an appropriate keying means 31 which could, by way of example only be a sheet of metal mesh. Said keying means 31 could be additional to the rear wall of the lintel 30 or formed as part of said wall. FIG. 3 illustrates a further embodiment of the invention wherein the element 10 is built into a cavity wall and is provided with a groove-like indentation **12*a*** acting as a mortar bed.

A segmental arch has been illustrated but elements according to the invention lend themselves to the formation of any shape of arch.

We claim:

1. An element which constitutes a combined formwork and cavity tray for use in bridging an opening in a wall, said element comprising: a first web portion having an inner edge, a second web portion having an inner edge, a third web portion having two edges of which one is connected to the inner edge of the first web portion and of which the other is connected to the inner edge of the second web portion, said third web portion making, in any transverse section through the element, an included angle of more than 90° with each of said first and second web portions, said second web portion being curved in the vertical direction toward the plane containing an uppermost elongate flat surface of said first web portion, said second web portion comprising the top wall of a second box-section member whose transverse cross-sectional area increases from a minimum at each of its ends to a maximum intermediate said ends by virtue of the curvature of said second web portion, the first web portion and the bottom wall of said second box-section member lying on parallel planes.

2. An element which constitutes a combined formwork and cavity tray for use in bridging an opening in a wall, said element comprising a first web portion having an inner edge, a second web portion having an inner edge, a third web portion having two edges of which one is connected to the inner edge of the second web portion, said third web portion making, in any transverse section through the element, an included angle of more than 90° with each of said first and second web portions, said first web portion being substantially straight throughout its longitudinal direction, said second web portion being curved in the vertical direction towards the plane containing the uppermost surface of said first web portion.

3. An element as claimed in claim 1, wherein said element is made of a glass reinforced plastics material.

4. An element as claimed in claim 2, where said first web portion constitutes a wall of a box-section member.

5. An element as claimed in claim 2, wherein an appropriate other wall of said second box-section member is provided with keying means to which mortar, cement, or plaster can be applied.

6. An element as claimed in claim 5, wherein said keying means comprises a rigid lathing or mesh.

7. An element as claimed in claims 2 or 3 or 4, wherein said second web portion comprises the top wall of a second box-section member whose transverse cross-sectional area increases from a minimum at each of its ends to a maximum intermediate said ends by virtue of the curvature of said second web portion, the first web portion, and the bottom wall of said second box-section member lying on parallel planes.

8. An element as claimed in claim 5, wherein a capillary groove is formed in said bottom wall.

9. An element as claimed in claim 5, wherein said top wall is extended in such a manner as to project beyond that side wall of said second box-section member which is remote from said inner edge, thereby providing a head drip.

10. An element as claimed in claim 5, wherein said top wall is so formed as to provide an indentation which, in use of the element, will serve as a bed or key for mortar or mastic compound used with the brickwork, blockwork or stonework extending upwardly from said top wall.

11. An element as claimed in claim 7, wherein the walls of said second box-section member enclose a void.

12. An element as claimed in claim 11, wherein said void is filled with a rigid material having high thermal resistance.

* * * * *

UNITED STATES PATENT AND TRADEMARK OFFICE

CERTIFICATE OF CORRECTION

PATENT NO. : 4,202,143

DATED : May 13, 1980

INVENTOR(S) : Brian Mear, et al

It is certified that error appears in the above—identified patent and that said Letters Patent is hereby corrected as shown below:

The title page should be deleted to insert the attached title therefor.

Signed and Sealed this

*Twenty-third* Day of *September 1980*

[SEAL]

*Attest:*

SIDNEY A. DIAMOND

*Attesting Officer*

*Commissioner of Patents and Trademarks*

United States Patent [19]

Mear et al.

[11] 4,202,143

[45] May 13, 1980

[54] COMBINED FORMWORK AND CAVITY TRAY

[76] Inventors: Brian Mear; Gary Smith, both of 26A Bull Ring, Ludlow, Shropshire, England

[21] Appl. No.: 914,514

[22] Filed: Jun. 12, 1978

[51] Int. Cl.[2] ..... E04D 13/00; E06B 1/04; E06B 1/24

[52] U.S. Cl. ..... 52/97; 52/204

[58] Field of Search ..... 52/85, 204, 89, 412, 52/454, 97

[56] References Cited

U.S. PATENT DOCUMENTS

| | | | |
|---|---|---|---|
| 2,669,114 | 2/1954 | Mills | 52/454 |
| 3,605,372 | 9/1971 | Wunderlich et al. | 52/204 |

FOREIGN PATENT DOCUMENTS

| | | | |
|---|---|---|---|
| 124271 | 5/1947 | Australia | 52/204 |
| 1965465 | 12/1968 | Fed. Rep. of Germany | 52/204 |
| 694214 | 3/1951 | United Kingdom | 52/204 |

*Primary Examiner*—James L. Ridgill, Jr.
*Attorney, Agent, or Firm*—Albert L. Jeffers

[57] ABSTRACT

A combined formwork and cavity tray element for use in the construction industry having first and second web portions joined together by a third web portion forming an included angle of more than 90° with each of the first and second web portions. The first web portion is substantially straight throughout its longitudinal direction and the second web portion is curved in the vertical direction towards the plane containing the uppermost elongate flat surface of the first web portion. If desired, the element may include a box-section wherein the second web portion comprises the top wall thereof.

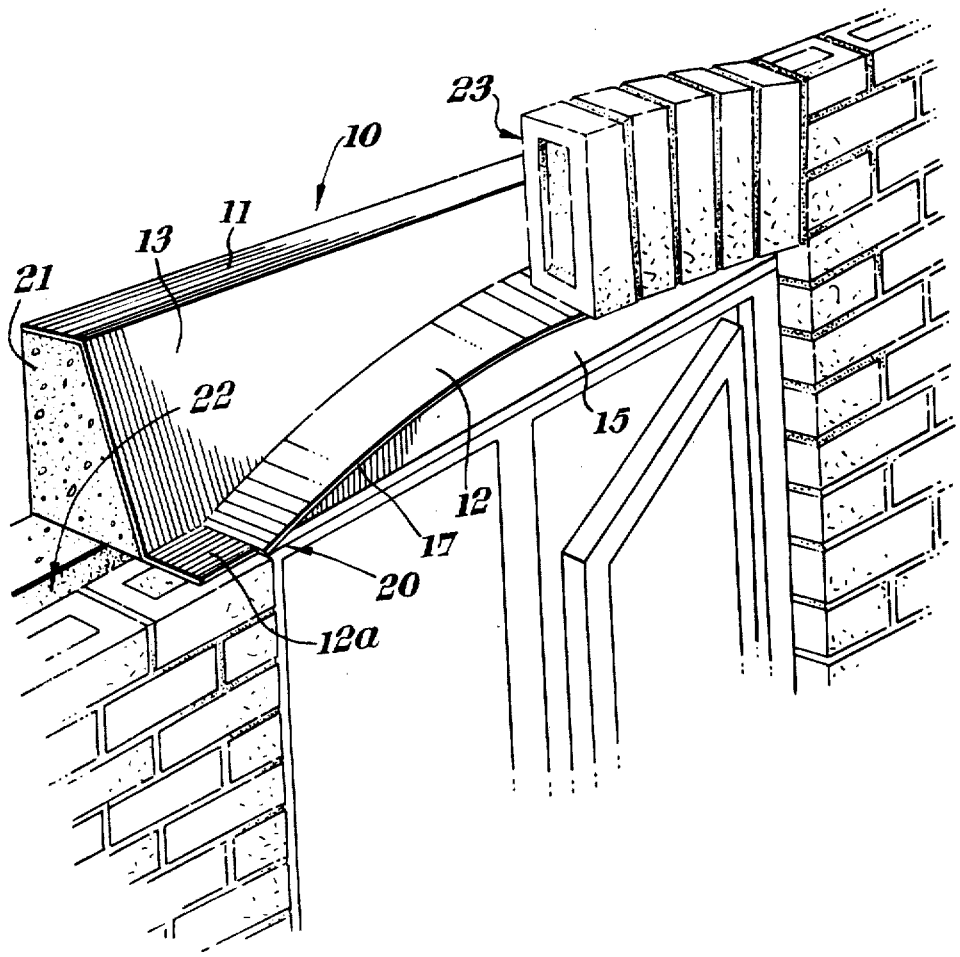

12 Claims, 4 Drawing Figures